US006481159B2

(12) United States Patent
Diston

(10) Patent No.: US 6,481,159 B2
(45) Date of Patent: Nov. 19, 2002

(54) SASH AND CASE WINDOWS

(75) Inventor: Alan Diston, Kirkcaldy (GB)

(73) Assignee: Arganex Limited, Kirkcaldy (GB)

( * ) Notice: Subject to any disclaimer, the term of this patent is extended or adjusted under 35 U.S.C. 154(b) by 0 days.

(21) Appl. No.: 09/448,939

(22) Filed: Nov. 24, 1999

(65) Prior Publication Data

US 2002/0040550 A1 Apr. 11, 2002

(51) Int. Cl.[7] ..... E05D 15/00
(52) U.S. Cl. ..... 49/142; 49/163
(58) Field of Search ..... 49/142, 143, 144, 49/145, 163, 164, 207, 192, 56, 62, 63; 160/96

(56) References Cited

U.S. PATENT DOCUMENTS

| | | | | | |
|---|---|---|---|---|---|
| 89,375 | A | * | 4/1869 | Anders | 49/164 X |
| 1,462,644 | A | * | 7/1923 | Lancaster | 49/164 |
| 1,587,658 | A | * | 6/1926 | Laycock | 49/56 |
| 2,563,003 | A | * | 8/1951 | Chartier | 49/164 X |
| 3,442,049 | A | * | 5/1969 | Nachtsheim | 49/164 |
| 419,900 | A | * | 4/1980 | Johnston et al. | 49/63 BP |
| 4,452,011 | A | * | 6/1984 | Trombettas | 49/56 |
| 4,592,168 | A | | 6/1986 | Struckmeyer | |
| 4,993,187 | A | * | 2/1991 | Schweiss et al. | 49/56 |
| 5,042,199 | A | * | 8/1991 | Schneider et al. | 49/446 |
| 5,410,841 | A | * | 5/1995 | Harris et al. | 49/56 |

FOREIGN PATENT DOCUMENTS

| | | | | |
|---|---|---|---|---|
| GB | 13009 | * | 1/1907 | 49/143 |
| GB | 0 688 097 | | 6/1951 | |
| GB | 1122382 | | 8/1968 | |
| GB | 2 004 935 A | | 4/1979 | |
| GB | 2 019 477 A | | 10/1979 | |
| GB | 2 057 543 A | | 4/1981 | |
| IT | 307500 | * | 5/1933 | 49/145 |

* cited by examiner

*Primary Examiner*—Jerry Redman
(74) *Attorney, Agent, or Firm*—Drinker Biddle & Reath LLP

(57) ABSTRACT

An improved window arrangement is disclosed. The window arrangement has the appearance of a conventional sash and case window from external a building having it fitted. However, the window benefits from improved insulation and sealing on a second sash provided to the interior of the building. Importantly, the innermost sash has a seal around the main frame of the window in a single plane.

8 Claims, 1 Drawing Sheet

SASH AND CASE WINDOWS

This invention relates to a window.

BACKGROUND OF THE INVENTION

The sash and case vertically sliding window is the most traditional window still in current production and use. It is also the lost difficult to insulate, draught proof and keep silent, but retains aesthetic appeal absent from most modern double glazed windows. Problems have also arisen with escape from the conventional windows because of difficulties in attaining the maximum escape height due to the relatively large size of the lower sash. Attempts have been made to improve the insulation properties of conventional sash and case windows using sliding and/or lift out internal secondary glazing but these have proved unacceptable to end users/building occupiers because of difficulties in access to the sash and case window for basic cleaning purposes.

Other attempts to overcome the problems associated with conventional sash and case windows have been made in the past using casement based outward opening and/or pivoting, arrangements which have lost appeal for the following, reasons:

1. Unacceptable and/or inconsistent forward/outward projection of opening sashes reduces the aesthetic effect, and there is a risk of sash/pedestrian collision at ground floor level.
2. The unacceptable bulky appearance of exposed frame and sash evident on external elevations and the resultant reduction in glass size, enecessitated by the method of opening, both of which are aesthetically displeasing.
3. The difficulty of weather sealing because gasketry (sealing) has to change planes vertically and is therefore not continuous thereby allowing ingress of wind and water.

SUMMARY OF THE INVENTION

According to the present invention, there is provided a window comprising a frame and first and second opening sashes, the second sash being openable inwardly of the frame and being glazed substantially over the full height of the window. Preferably, the first sash is slidable in the frame.

In the event of the window being part of a replacement or major repair/renovation process the first sash could be formed by the original upper sash being salvaged or recycled. It can be hung on weighted cords or chains, or on sprung balances. The second (inner) sash may be full size within the frame of the window and can be bottom and/or side hung for inward opening. One mechanism for doing this may be any conventional "tilt and turn" opening mechanism. Preferably, a seal is provided around the second sash which meets the frame in a single plane. It can be double glazed its full height with a hermetically sealed unit.

The second sash can have a non-functional "meeting tail" in line with bottom rail of the outer or upper sash (when in its uppermost position). However, the meeting rail may co-operate with a sealing strip provided on the outer sash. The strip may seal against the second sash when the window is fully closed, thereby helping to secure the first sash to prevent noise (eg wind rattle) caused by movement of the first sash. Astragal bars can be incorporated in the outer sash and in the bottom half of the inner sash (ie below the meeting rail) to suit decorative requirements.

The outer sash, being vertically slidable, can be lowered to a desired position for cleaning both faces of the glass from within the building, at a safe working height to suit the individual. This sash can also be positioned such that it forms a safety balustrade while cleaning or servicing the sashes.

The mechanism controlling the movement of the second (inner) sash can be exposed, or semi or totally concealed; locks can be provided to limit its operation to authorised persons and/or to ensure that bottom hung and side hung actions of the hinging system cannot be achieved at the same time. Preferably the second sash can over-rebate the frame on its inward-facing surface. This provides clean uninterrupted cover and conceals operating gear and any adjustment from view.

Both sashes can be glazed with single or double glazed units from within the building and can be easily removed for repairs or replacement; the second sash by a concealed release mechanism at the top; the first (outer) sash by opening the inner sash, removing the parting bead between the two sashes, and releasing the weights or balances. Reinstallation may be by the same process in reverse The outer (first) sash may improve the decorative appearance of the window, which should look similar to a traditional sash and case window, but retain the advantages of double glazing in terms of its insulation, quick release, opening and easy cleaning. thee outer sash also provides additional thermal and acoustic insulation at the top portion of the window. In effect, in the fully closed position, with the outer sash up, the top part of the window unit may be triple glazed.

BRIEF DESCRIPTION OF THE DRAWINGS

A specific embodiment of the window will now be described by way of example only with reference to the accompanying drawings in which.

DETAILED DESCRIPTION OF THE DRAWINGS

Figures 1, 2, 3, 4:
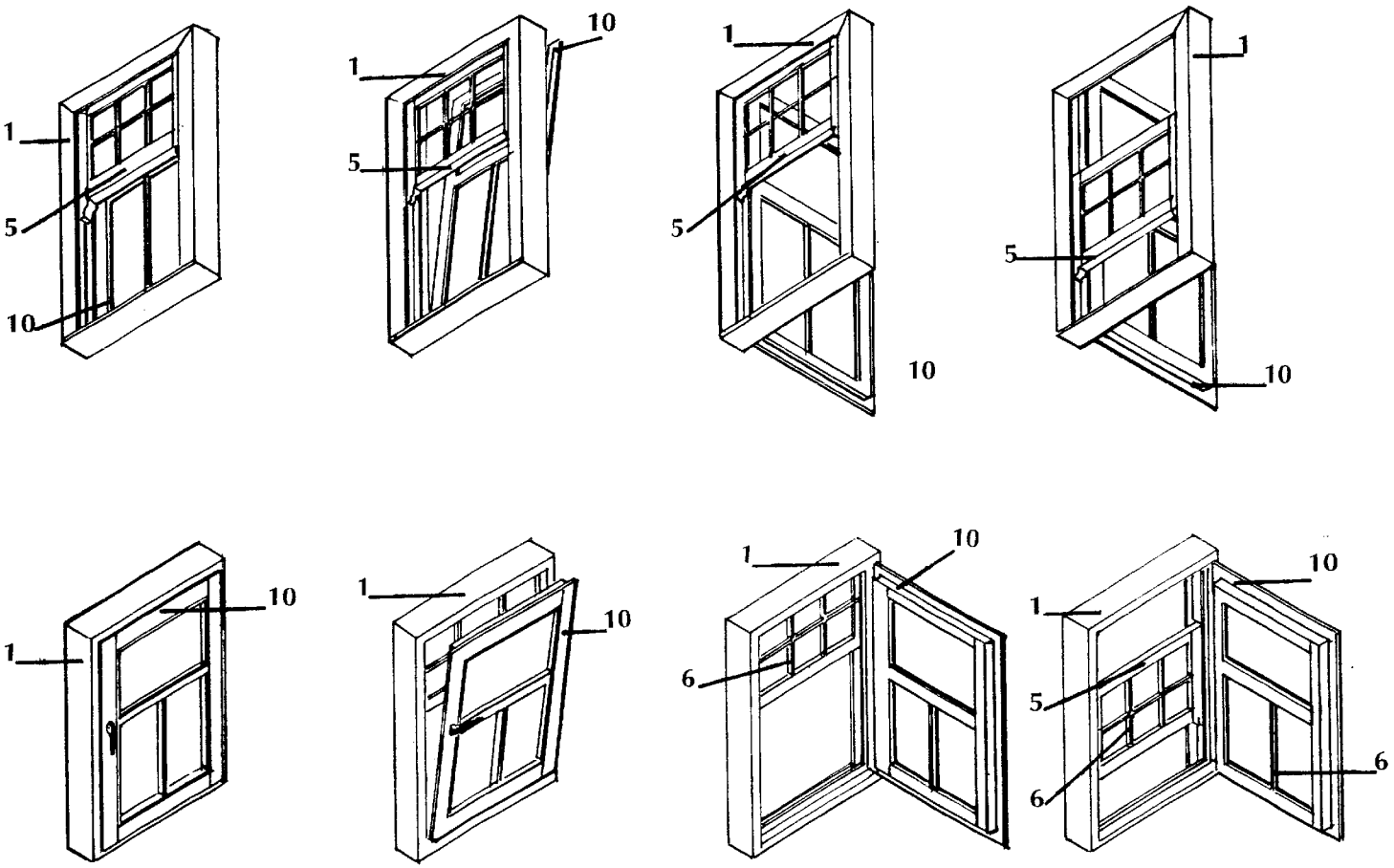
FIG. 1 shows in perspective a window in accordance with the present invention in the secure closed position.
FIG. 2 shows in perspective the window of FIG. 1 in the secure vented position with the outer sash fully raised.
FIG. 3 shows in perspective the window of FIG. 1 in the fully open position for escape purposes with outer sash fully raised.
FIG. 4 shows in perspective the window of FIG. 1 in the fully open position for cleaning purposes with outer sash fully lowered.

Referring now to the drawings, a window has a main frame 1 and a first (outer) sash 5 which is slidable vertically in the main frame 1 and is approximately four ninths the height thereof. (It should be noted that any ratio of size of outer sash to size of frame can be used, depending on aesthetic and/or regulatory limitations.) The drawings in FIGS. 1 to 4 each show the window from two separate views. The top view is a view upwards from outside, and the bottom view is a view downwards from inside The first (outer) sash 5 is generally rectangular and in this example is constructed from wood covered with a protective coating. Other embodiments are envisaged in which the construction is of plastic, aluminium or other suitable composites. The outer sash 5 may or may not have horns. The example shown in fact has a pair of horns, although these are not essential. The outer sash 5 is mounted within a recess provided around the interior of the main frame 1, so that it is free to slide up and down in a vertical plane, as with common sash arrangements. The outer sash 5 is provided with a concealed spring arrangement located within compartments in the main frame 1. The spring arrangement is of known type, for counterbalancing the outer sash 5. The arrangement may be adjustable, as required, or may be replaced with weights, or the like in other embodiments of the present invention.

In this embodiment the outer sash is single glazed in six panes, arranged decoratively with astragal bars running horizontally and vertically between the panes.

The window also has an inner sash 10 which is dimensioned to extend over the full height and breadth of the frame 1. The inner sash 10 in this example is double glazed in three panels. The panels as shown are generally rectangular, one of which lies horizontally and is separated from the other two by a horizontal meeting rail. The panels may be of other shapes in diifferent embodiments. The other two panels are below the first and positioned side-to-side vertically with a vertical astragal bar between them. The inner sash 10 is hinged connected to the frame 1 and/or can be mounted on conventional "tilt and turn" mechanisms known in the art.

The inner sash 10 can be sealed to the frame 1 in the closed position (FIG. 1) by seals concealed within the perimeter of the inner sash 10 in a single plane. Alternatively, the seals may be mounted on the main frame instead of the sash. This has the advantage of completely sealing the window in the closed position. in the closed position of FIG. 1, the top portion of the window is triple glazed, because of the extra panel provided by the outer sash 5. Advantageously, the lower rail of the outer sash may have a sealing strip running therealong. This sealing strip seals against the inner sash in the closed position of FIG. 1 (with the outer sash up) and helps to prevent the outer sash from rattling in the wind, and further improves insulation.

Water collection and drainage channels can be provided at the bottom of the inner sash 10 to collect and usher water towards the outside of the window.

In this example, from the closed position, the inner sash may be moved into the vented position of FIG. 2 by turning the handle to the horizontal position (after unlocking if required) and tilting the top of the sash 10 inwards. The sash 10 is supported in this position by concealed mountings on its lower edge and the lower interior surface of the main frame 1. In this secure vented position, air can flow through the void between the two sashes, 5, 10, but strong gusts are blocked by the outer sash 5. This allows for ventilation without exposing the building occupants to harsh weather conditions, and with the safety of having the window cavity essentially still blocked The inner sash 10 can be hingedly connected to the side of the main frame 1 and can be pivoted inwardly for cleaning of the outer and inner faces thereof. This is the position seen in FIG. 3. This is achieved from the closed position (FIG. 1) by turning the handle through 130° and pulling the sash 10 inwards on its side hinges, (Concealed) which are now activated. Clearly, this not only enables cleaning, but also allows for escape from the building having the window therein, by climbing out of the space underneath the outer sash 5. Furthermore, firemen, or other emergency rescue teams may enter a building through this space. Advantageously, the inner sash 10 opens inwardly which means it is easier for a member of a rescue operation to break through the window in an emergency situation, as the movement from outside to inside goes with the direction of movement of the side hinges. The outer sash 5 can be slid vertically downwards in the frame 1 so as to permit easy cleaning of both sides thereof. This is the position seen in FIG. 4. The horns on the outer sash 5 butt against restrictors provided in the bottom interior corners of the frame 1 when the sash 5 reaches its desired lowermost position (as seen in FIG. 4). The gap below the sash 5 is small enough to prevent children from climbing out of the window, and the outer sash 5 acts as a safety barrier against anyone falling out of the window while it is in this open position.

The two sashes 5, 10 can incorporate astragal bars 6 for decorative and/or security purposes. The inner sash 10 can preferably incorporate a meeting rail at the same height as the bottom rail of the frame of the first (outer) sash 5.

Modifications and improvements can be incorporated without departing from the scope of the invention.

I claim:

1. A sash and case window comprising a frame and first and second opening sashes, the first and second sashes being provided in two distinct vertical planes of the frame, each sash being provided in one vertical plane, wherein the first sash is slidable within a vertical opening plane and is the only slidable sash within the frame and the second sash is full size within the frame such that an opening is provided in any portion of the frame not filled by the first sash, the second sash being openable inwardly of the frame and being glazed substantially over the full height of the window.

2. A window as claimed in claim 1, wherein the second sash in one of the bottom and side hung for inward opening.

3. A window as claimed in claim 1, wherein a seal is provided around the second sash which meets the frame in a single plane.

4. A window as claimed in claim 1, wherein the first sash is provided with a sealing strip for sealing against the second sash.

5. A window as claimed in claim 1, wherein a mechanism is provided for controlling movement of the second sash and said mechanism is semi or totally concealed.

6. A window as claimed in claim 1, wherein the second sash is over-rebated around its inward-facing surface.

7. A window as claimed in claim 1, wherein one or both sashes is decorated with bars.

8. A window as claimed in claim 1, wherein one or both sashes is multi glazed.

* * * * *